US008051882B2

(12) United States Patent
Koeninger et al.

(10) Patent No.: US 8,051,882 B2
(45) Date of Patent: Nov. 8, 2011

(54) TANKER TRUCK MONITORING SYSTEM

(75) Inventors: Robert C. Koeninger, Fairfield, OH (US); Charles A. Braun, Cincinnati, OH (US)

(73) Assignee: Dixon Valve and Coupling Company, Chestertown, MD (US)

( * ) Notice: Subject to any disclaimer, the term of this patent is extended or adjusted under 35 U.S.C. 154(b) by 566 days.

(21) Appl. No.: 12/251,887

(22) Filed: Oct. 15, 2008

(65) Prior Publication Data

US 2010/0089486 A1 Apr. 15, 2010

(51) Int. Cl.
*B65B 1/30* (2006.01)

(52) U.S. Cl. ..... 141/95; 141/98

(58) Field of Classification Search ..... 141/83, 141/93, 95, 98, 192, 197, 198, 2, 4
See application file for complete search history.

(56) References Cited

U.S. PATENT DOCUMENTS

| | | | | |
|---|---|---|---|---|
| 5,424,720 | A * | 6/1995 | Kirkpatrick | 340/585 |
| 5,771,178 | A | 6/1998 | Stemporzewski, Jr. et al. | |
| 6,584,997 | B1 | 7/2003 | Blichmann et al. | |
| 7,171,989 | B2 | 2/2007 | Corless et al. | |
| 7,246,009 | B2 * | 7/2007 | Hamblen et al. | 701/209 |
| 7,412,994 | B2 | 8/2008 | Corless et al. | |

* cited by examiner

*Primary Examiner* — Davis Hwu
(74) *Attorney, Agent, or Firm* — Wood, Herron & Evans, LLP

(57) ABSTRACT

A system and method is provided to monitor a tanker truck. The system includes a plurality of sensors, each of the plurality of sensors configured to detect an event. The system also includes a monitoring unit electrically coupled with the plurality of sensors to detect the event. The monitoring unit includes a processing unit, a time module, and a memory, and is operable to time stamp data about the sensed event with information from the time module and store the detected and time stamped event in the memory. The system further includes a handheld data terminal configured to communicate with the monitoring unit. The handheld data terminal is operable to retrieve and display the stored event, and includes a processing unit, a memory, a user interface, a time module, and a display.

34 Claims, 9 Drawing Sheets

380

TANKER TRUCK MONITORING SYSTEM

FIELD OF THE INVENTION

The present invention relates to a system to monitor trucks operable to carry fluids, and in particular flammable fluids such as petroleum products.

BACKGROUND OF THE INVENTION

Modern transportation of liquids generally expends a significant amount of time and money. Though some liquids, such as water, sewage, etc., are generally transported by a pipeline, other liquids are often too delicate or too dangerous to transport by pipeline and are typically transported by tanker truck. In particular, liquid fuels are expensive, hazardous, and prone to handling error and theft, and therefore transport by tanker trucks is common for motor transportation of liquid fuels to retail outlets. In particular, liquid fuels are typically transported by tanker trucks under the recommended practices specified by the American Petroleum Institute (API) and the National Fire Protection Association (NFPA). These organizations have standards that define how liquid fuels are to be loaded, unloaded and transported within the United States. These standards have typically become common practices in most regions of the world.

The API Recommended Practice 1004 defines the use of an overfill system on conventional DOT-406 and MC-306 tanker trucks. During fuel loading, the primary means to shut off the flow of fuel is typically through a metering system at a gantry controller that measures the amount of fuel being loaded. Once a specified amount has been loaded, the gantry controller typically shuts off fuel pumps. Conventional overfill systems, however, are secondary emergency shut off systems. Conventional overfill systems generally include one or more overfill sensors mounted inside the tank, and often include one overfill sensor for each compartment of the tank. Conventional overfill systems typically communicate a permissive signal to the gantry controller to indicate that the gantry controller may load the tanker truck. When an overfill sensor becomes wet, conventional overfill systems typically prohibit the permissive signal to prevent further fuel loading, often stopping the loading process midway. Thus, conventional overfill systems generally have the primary purpose to prevent a fuel spill should the metering system fail.

These conventional overfill systems are generally electronic devices coupled to electronic sensors that are designed detect an overfill condition. Conventional overfill systems often operate in harsh and varied environments, and generally experience extreme temperatures, jostling, rocking, stretching, swaying, bumps, noxious vapors, and electrical disturbances. In particular, conventional overfill systems are typically susceptible to vibration and environmental corrosion, as well as rough handling by operators. As such, conventional overfill systems are often prone to failure. For example, sensors and wires may experience wear and intermittently send signals that may erroneously indicate a fault, or overfill condition. Similarly, sensors and wires may experience wear and intermittently fail to send signals that indicate a fault, or overfill condition. These intermittent problems may prevent loading of the tanker truck. After being denied the ability to load, operators typically return to a maintenance bay to determine the cause of the problem, but these intermittent problems are often hard to reproduce. Thus, these problems are often either ignored (possibly leading to dangerous overfills, spills, improper loading, and/or improper unloading) or addressed through potentially unnecessary and costly repair or replacement (including repair or replacement of the sensors, wires, and/or monitoring system, or even replacement of a compartment or the entire tank). As such, conventional overfill systems are typically unable to quickly and easily allow technicians to diagnose problems that occur intermittently as they are often unable to track those problems and/or reproduce those problems in a timely and efficient manner.

Furthermore, operator error is often another source of loading problems. Operators may commit a number of errors resulting in overfill and/or loading rejections from the gantry controller. Moreover, operators often commit a number of errors that result in potentially hazardous conditions, including attempting to enter an amount of fluid in excess of a compartment's capacity, connecting a filling line to an inlet for the wrong compartment than intended, and/or attempting to load a compartment that has remaining fluid from a previous load. Other typical operator errors include failing to connect the tanker truck to ground before filling, failing to establish a vapor connection between the compartment being filled and the supply tank supplying the liquid to the compartment, failing to set brakes of the tanker truck, and/or failing to engage one or more safety interlocks of the tanker truck. Conventional overfill systems are typically unable to monitor these conditions and prevent loading problems that typically occur due to operator error.

Additionally, tanker trucks are often prone to theft. As the cost of fuel rises, theft of fuel from tanker trucks generally increases. To steal the fuel, operators typically drain the bottom piping of the tanker truck that leads from the inlet to a compartment. However, this theft is often difficult to detect, as the operators typically make an unauthorized stop at some remote location and drain the fuel from the piping for personal use or black market sale. Up to about forty gallons may be drained from the bottom piping without affecting the liquid level of the compartments of the tanker truck. Conventional overfill systems are also typically unable to monitor either the tanker truck piping or the tanker truck location to detect theft of the fuel.

Moreover, errors often occur when unloading the tanker truck. One error common includes delivering a load to the wrong location, which results in non-payment by the intended recipient as well as non-payment by the unintended recipient. Another error includes unintentionally mixing fluids in tanks, which results in additional expenditures associated with pumping out that mixed fluid and proper disposal. Conventional overfill systems are unable to monitor the unloading of the tanker truck to determine errors that may occur.

Consequently, there is a continuing need to overcome these deficiencies.

SUMMARY OF THE INVENTION

The invention provides for a system and method to monitor a tanker truck that includes at least one compartment to retain a fluid. The system includes a plurality of sensors, each of the plurality of sensors configured to detect an event. The system also includes a monitoring unit electrically coupled with the plurality of sensors to detect the event. The monitoring unit includes a processing unit, a time module, and a memory, and is operable to time stamp the sensed event with information from the time module and store the detected and time stamped event in the memory. The system further includes a handheld data terminal configured to communicate with the monitoring unit. The handheld data terminal is operable to retrieve and display the stored event, and includes a processing unit, a memory, a user interface, a time module, and a display.

These and other advantages will be apparent in light of the following figures and detailed description.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

Figure 1:
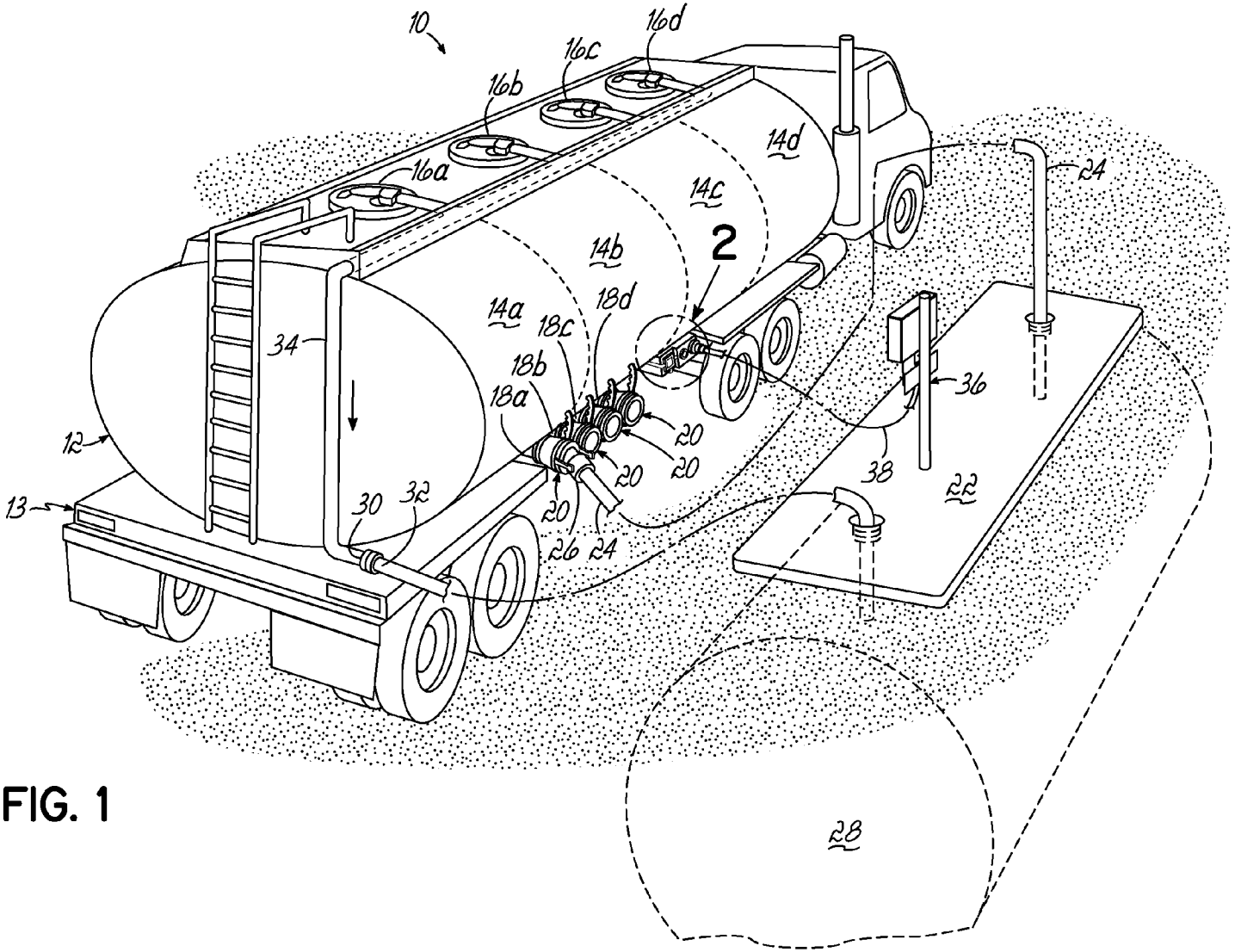
FIG. 1 is a perspective view of a tanker truck being loaded with fuel at a loading island consistent with embodiments of the invention.

It should be understood that the appended drawings are not necessarily to scale, presenting a somewhat simplified representation of various preferred features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments may have been enlarged or distorted relative to others to facilitate visualization and clear understanding.

DETAILED DESCRIPTION

Embodiments of the invention include a method and monitoring system to monitor a tanker truck. In some embodiments, the tanker truck may include a tank with a plurality of compartments, and the monitoring system may include a monitoring unit, a handheld data terminal, and a computer. The monitoring unit monitors a plurality of sensors to detect an event. In some embodiments, these sensors may include an overfill sensor, a retain sensor, a brake sensor, a valve sensor, a vapor connection sensor, a ground sensor, a socket sensor, and a safety interlock sensor. Upon detecting an event, such as an overfill condition, a retain condition, the engagement or disengagement of a brake, the opening or closing of an American Petroleum Institute (API) valve, the establishment or loss of a vapor connection, the establishment or loss of a ground connection, the establishment or loss of an electrical connection to a gantry controller, and/or the engagement or disengagement of a safety interlock, the monitoring unit may timestamp the event and store an indication of the event and the timestamp as event information in a memory.

The monitoring unit may communicate with the handheld data terminal, which may be used to download data, such as programming information, identification information, event information, or fluid information from the monitoring unit. The handheld data terminal may also be used to download data, such as programming information, identification information, or fluid information to the monitoring unit. The handheld data terminal may be further configured to display the event information. The handheld data terminal, in turn, may communicate with the computer, which may also display the event information through an event display application. Advantageously, it is believed that this allows intermittent or otherwise transient events to be viewed by users to diagnose errors.

In some embodiments, the monitoring unit may be coupled to a Global Positioning Satellite (GPS) receiver. Thus, the monitoring unit may determine the GPS location of the tanker truck in response to detecting the event. In alternative embodiments, the monitoring unit may determine the GPS location of the tanker truck at predetermined time intervals. Advantageously, it is believed that the monitoring system may detect theft of liquid from the tanker truck by determining when an API valve to a compartment is open, determine the time of this event, and determine the location of the tanker truck at about the time of the event.

In some embodiments, the monitoring unit may communicate with the handheld data terminal through a cable. Similarly, in some embodiments the handheld data terminal may communicate with the computer through a cable. In alternative embodiments, the monitoring unit may communicate with the handheld data terminal and/or computer through wireless communication. Similarly, in alternative embodiments the handheld data may communicate with the monitoring unit and/or computer through wireless communication. In particular embodiments, the monitoring unit may communicate with the handheld data terminal through low-power wireless communication and communicate with the computer through long range wireless communication.

Tanker Truck

FIG. 1 illustrates a tanker truck 10 having a tank 12 mounted on a trailer 13. The tank 12 is configured with four compartments 14*a*, 14*b*, 14*c*, and 14*d* configured to retain a fluid and having respective covers 16*a*, 16*b*, 16*c*, and 16*d*. Although four compartments 14*a*, 14*b*, 14*c*, and 14*d* are illustrated in FIG. 1 by dashed lines, these dashed lines are for illustration purposes only. As such, there may be any number of compartments in any location in the tank 12. In some embodiments, the tank 12 may have one or up to about eight compartments. Below the tank 12 are a plurality of pipes 18*a*, 18*b*, 18*c*, and 18*d* in fluid communication with the respective compartments 14*a*, 14*b*, 14*c*, and 14*d*. Each of the pipes 18*a*, 18*b*, 18*c*, and 18*d* may have a valve assembly 20 located at the end thereof for loading fluid into the compartments and unloading fluid from the compartments in a manner known in the art. In specific embodiments, each valve assembly 20 may include an American Petroleum Institute (API) valve as is well known in the art.

Fluid, such as liquid fuel, is loaded into the compartments 14*a*, 14*b*, 14*c*, and 14*d* at a loading rack or island 22. The loading rack 22 has at least one dispensing line 24 which draws fluid from a fluid supply 28 via a pump (not shown). The dispensing line 24 typically traverses a gantry (not shown) to the truck 10, where the end of the dispensing line 24 is mechanically coupled to the valve assembly 20 via a coupler 26. In specific embodiments, each coupler 26 may couple to the API valve as is well known in the art. Although one embodiment of loading rack 22 is illustrated and described, any number of different loading racks may be used in accordance with the present invention.

Although FIG. 1 illustrates the fluid supply 28 being in the form of a holding tank located underneath the loading island 22, the fluid supply 28 may assume other forms and may be remotely located from the loading island 22. Similarly, although one dispensing line or hose 24 is illustrated being connected to pipe 18*a* to fill compartment 14*a*, any number of dispensing lines may be operational at the same time to fill multiple compartments simultaneously. In some embodiments, the compartments may be filled with different types of fuel drawn from different fuel supplies.

A vapor recovery fitting 30 forms part of the tank 12 and may be connected to a vapor recovery hose 32 which extends between the vapor recovery fitting 30 and the supply tank 28, as is conventional in the art to prevent vapors from escaping to the atmosphere. The vapor recovery fitting 30 is in fluid communication with a vapor connection hose 34 that may be connected to at least one of the covers 16*a*, 16*b*, 16*c*, and/or 16*d* to remove vapor from the respective compartments 14*a*, 14*b*, 14*c*, and 14*d* as they are loaded with fluid. The dispensing line 24, coupler 26, hoses 24, 32, 34, vapor recovery fitting 30 and fuel supply 28 are all conventional in the art. The invention of the present application is not intended to be limited by the number, configuration or operation of these items.

Figure 2:
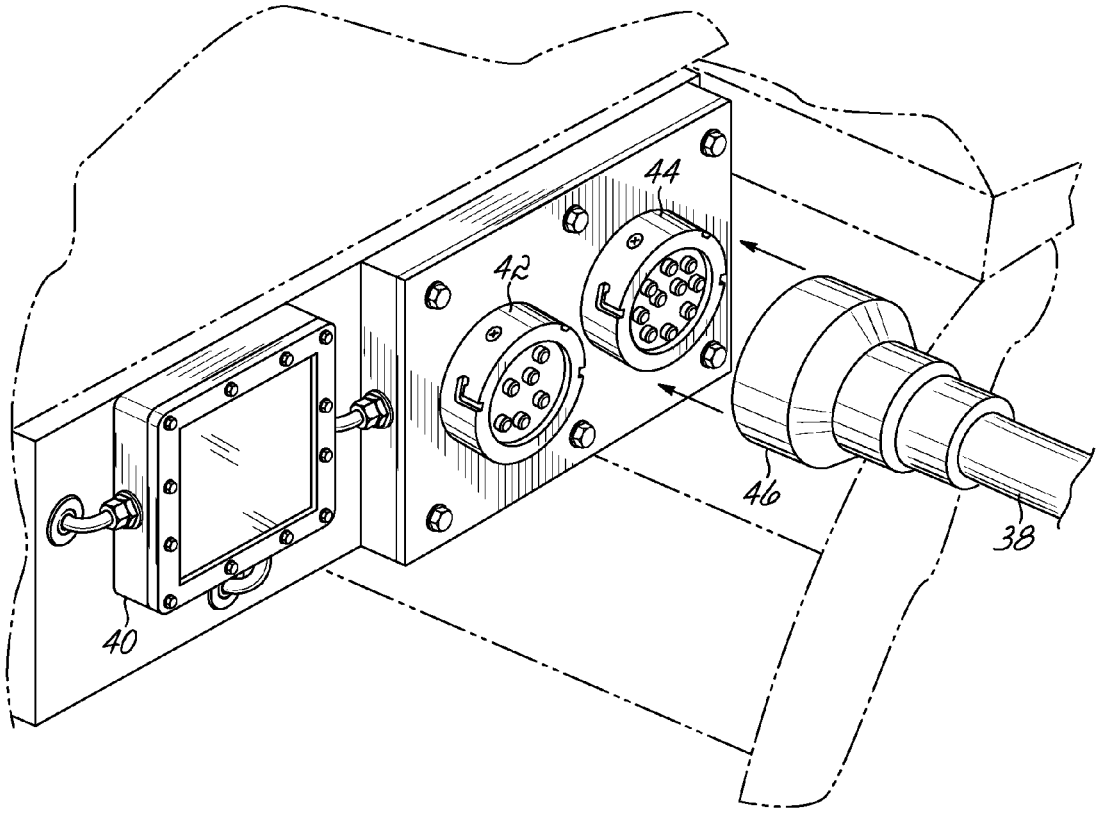
FIG. 2 is an enlarged view of the circled area 2 of FIG. 1 and illustrates a monitoring unit consistent with embodiments of the invention.

At the loading island 22 is a gantry controller 36 which has a cable 38 extending outwardly therefrom. The gantry controller 36 may control the pump to load the fluid to at least one compartment 14*a*, 14*b*, 14*c*, or 14*d*. In some embodiments, the gantry controller 36 may load the fluid in response to a permissive signal from the truck 10. FIG. 2 is an illustration of a monitoring unit 40 that may provide the permissive signal through at least one socket 42, 44 to a plug 46 secured to the end of cable 38, and thus to the gantry controller 36. The monitoring unit 40 is configured to detect and store events and provide or prohibit the permissive signal, among other tasks. As shown in FIG. 2, there are two sockets 42, 44, each with a different configuration of contact points to communicate with different plugs and different gantry controllers. Socket 42 may be an "optic" type socket traditionally used to directly communicate with optic sensors disposed within the compartments 14*a*, 14*b*, 14*c*, and 14*d* of the truck 10, while socket 44 may be a "thermistor" type socket traditionally used to directly communicate with thermistor sensors disposed within the compartments 14*a*, 14*b*, 14*c*, and 14*d* of the truck 10. In some embodiments, the monitoring unit 40 communicates directly with the overfill sensors and provides the permissive signal to either, or both, of the sockets 42, 44. Although socket 42 and 44 are shown in FIG. 2, one having ordinary skill in the art will appreciate that the truck 10 may include only one type of socket 42 or 44, and thus the monitoring unit 40 may be connected to only that socket 42 or 44.

Figure 3:
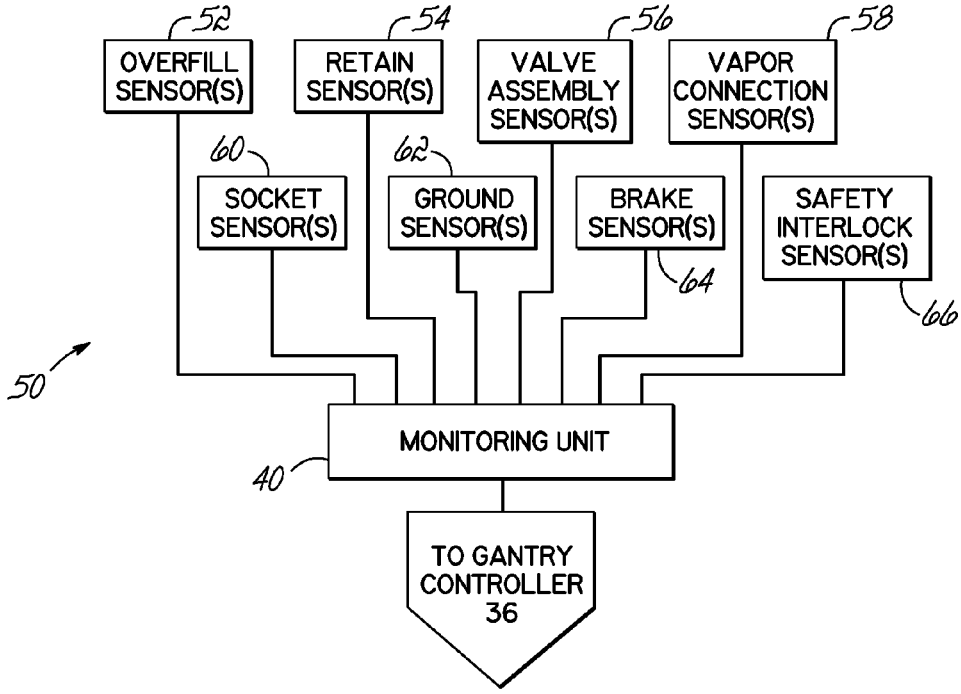
FIG. 3 is a block diagram of couplings of a plurality of sensors to a monitoring unit consistent with embodiments of the invention.

To load a compartment 14*a*, 14*b*, 14*c*, or 14*d*, a permissive signal for that compartment 14*a*, 14*b*, 14*c*, or 14*d* must be supplied to the gantry controller 36. When the permissive signal is absent, the gantry controller 36 may refuse to load the compartment 14*a*, 14*b*, 14*c*, or 14*d* that does not have a permissive signal, or may refuse to load all the compartments 14*a*, 14*b*, 14*c*, and 14*d*. The monitoring unit 40 may supply the permissive signal to the gantry controller 36 based upon analysis of a plurality of inputs from a plurality of sensors disposed throughout the truck 10 and/or tank 12. FIG. 3 is a block diagram 50 of a plurality of couplings between the plurality of sensors and the monitoring unit 40. In some embodiments, the tank 12 includes at least one overfill sensor 52 and at least one retain sensor 54 within each compartment 14*a*, 14*b*, 14*c*, and 14*d*. Each overfill sensor 52 and retain sensor 54 may be electrically coupled to the monitoring unit 40. Each overfill sensor 52 is configured to determine if that sensor is dry and functioning properly, and provide a signal indicating that determination to the monitoring unit 40. If an overfill sensor 52 is wet and/or malfunctioning, the monitoring unit 40 may prevent the permissive signal for at least that compartment 14*a*, 14*b*, 14*c*, or 14*d* configured with that wet and/or malfunctioning overfill sensor 52. Similarly, each retain sensor 54 is configured to determine if that sensor is dry and functioning properly, and provide a signal indicating that determination to the monitoring unit 40. If a retain sensor 54 is wet and/or malfunctioning, the monitoring unit 40 may prevent the permissive signal for at least that compartment 14*a*, 14*b*, 14*c*, or 14*d* configured with that wet and/or malfunctioning retain sensor 54. Additionally, when an overfill sensor 52 and/or retain sensor 54 becomes dry, wet, and/or malfunctions the monitoring unit 40 may record that event and store an indication of the time of that event. In some embodiments, each overfill sensor 52 may be an FT101, an FT151, or an FT202 series overfill sensor as distributed by DixonBayco of Chestertown, Md. In some embodiments, each retain sensor 54 may be an FT152 or an FT206 series retain sensor as distributed by DixonBayco.

In some embodiments, the tank 12 may also include at least one valve sensor 56 electrically coupled to the monitoring unit 40 to monitor at least one valve assembly 20. Each valve sensor 56 is configured to provide a signal indicating whether an API valve of at least one compartment 14*a*, 14*b*, 14*c*, or 14*d* is open. When the valve sensor 56 indicates an open and/or closed API valve, the monitoring unit 40 may record that event and store an indication of the time of that event. In some embodiments, each valve sensor 56 may be disposed in a pipe 18*a*, 18*b*, 18*c*, or 18*d*, and may be a pressure sensor as is well known in the art. In alternative embodiments, each valve sensor 56 may be in mechanical communication with an API valve to determine when a poppet of each API valve is open. In further alternative embodiments, each valve sensor 56 may be configured to measure the fluid in and/or out of a compartment 14*a*, 14*b*, 14*c*, or 14*d* or pipe 18*a*, 18*b*, 18*c*, or 18*d*.

In some embodiments, the tank 12 may further include at least one vapor connection sensor 58 electrically coupled to the monitoring unit 40 to determine whether a vapor connection has been established between the tank 12 and supply tank 28. In specific embodiments, one vapor connection sensor 58 may be configured for each compartment 14*a*, 14*b*, 14*c*, or 14*d* to determine whether a vapor connection has been established between that compartment 14*a*, 14*b*, 14*c*, or 14*d* and a fluid supply. When the vapor connection sensor 58 indicates that a vapor connection has been established and/or eliminated between at the tank 12 and/or the compartment 14*a*, 14*b*, 14*c*, or 14*d*, the monitoring unit 40 may record that event and store an indication of the time of that event. In some embodiments, each vapor connection sensor 58 may be disposed in a cover 16*a*, 16*b*, 16*c*, or 16*d*, and may be a pressure sensor as is well known in the art. In alternative embodiments, each vapor connection sensor 58 may be in mechanical communication with the vapor connection hose 34 to determine when a fluid connection between the vapor connection hose 34 and the respective compartment 14*a*, 14*b*, 14*c*, or 14*d* is established.

In some embodiments, the tank 12 may additionally include at least one socket sensor 60 electrically coupled to the monitoring unit 40 to determine whether an electrical connection has been established with the gantry controller 36. In specific embodiments, one socket sensor 60 is configured for each socket 42, 44 to determine whether an electrical connection has been established between that socket 42, 44 and the gantry controller 36. When the socket sensor 60 indicates that an electrical connection to the gantry controller 36 has been established and/or eliminated, the monitoring unit 40 records that event and stores an indication of the time of that event.

In some embodiments, the truck 10 and/or the tank 12 may include at least one ground sensor 62 electrically coupled to the monitoring unit 40 to determine whether a connection to an electrical ground has been established. When a connection to the electrical ground has not been established, the monitoring unit 40 may prevent the permissive signal to the gantry controller 36. As such, when the ground sensor 62 indicates that a connection to the electrical ground has been established and/or eliminated, the monitoring unit 40 may record that event and store an indication of the time of that event.

In some embodiments, the truck 10 and/or the tank 12 may also include at least one brake sensor 64 electrically coupled to the monitoring unit 40 to determine whether brakes of the truck 10 and/or the tank 12 have been engaged. When the brakes of the truck 10 and/or the tank 12 have not been set, the monitoring unit 40 may prevent the permissive signal to the gantry controller 36. As such, when the brake sensor 64 indicates that the brakes have and/or have not been set, the monitoring unit 40 may record the event and store an indication of the time of that event.

In some embodiments, the truck 10 and/or the tank 12 may further include at least one safety interlock sensor 66 electrically coupled to the monitoring unit 40 to determine whether safety interlocks of the truck 10 and/or tank 12 have been engaged. In some embodiments, safety interlocks may include pressure controllers or pressure valves to prevent the inadvertent or deliberate venting of vapors from the tanks, electronic governors that prevent the truck 10 from being started as fluid is transferred from the supply tank 28 to the compartments 14*a*, 14*b*, 14*c*, and 14*d* of the tank 12, electronic circuits such as relays that electronically isolate the truck 10 from the tank 12 as fluid is transferred from the supply tank 28 to the compartments 14*a*, 14*b*, 14*c*, and 14*d* of the tank 12, a "dead man's" switch to prevent fluid loading when it is not activated by the operator, a safety interlock bar to prevent access to at least one valve assembly 20 and/or the vapor recovery fitting 30 of the tank 12 (e.g., a bar that, when lifted, allows access to at least one valve assembly 20 and/or the vapor recovery fitting 30 such that, when lifted, the brakes of the truck 10 are engaged), and/or other safety interlocks well known in the art. When the safety interlock sensor 66 indicates that the safety interlocks have been engaged and/or disengaged, the monitoring unit 40 may record the event and store an indication of the time of that event. Thus, as shown in FIG. 3, the truck 10 and/or tank 12 may include a plurality of sensors 52-66 electrically coupled to the monitoring unit 40 to indicate various events of the truck 10 and/or tank 12.

Based on the inputs from one or more of the plurality of sensors 52-66, the monitoring unit 40 may monitor the truck 10 and/or tank 12 for events, such as incorrect connections, incorrect operation, operator errors, error conditions, and/or inconsistencies in operation. In specific embodiments, events may include an overfill condition and/or cessation of an overfill condition of at least one compartment 14*a*, 14*b*, 14*c*, or 14*d* (as indicated by the at least one overfill sensor 52), a retain condition and/or cessation of a retain condition of at least one compartment 14*a*, 14*b*, 14*c*, or 14*d* (as indicated by the at least one retain sensor 54), an open and/or closed condition of the valve assembly 20 for at least one pipe 18*a*, 18*b*, 18*c*, or 18*d* of at least one respective compartment 14*a*, 14*b*, 14*c*, or 14*d* (as indicated by the at least one valve assembly sensor 56), an establishment of a vapor connection and/or loss of a vapor connection of at least one compartment 14*a*, 14*b*, 14*c*, or 14*d* (as indicated by the at least one vapor connection sensor 58), an establishment of an electrical connection and/or a loss of an electrical connection between a socket 42, 44 and the gantry controller 36 (as indicated by the at least one socket sensor 60), an establishment of an electrical connection to a ground and/or a loss of an electrical connection to a ground (as indicated by the at least one ground sensor 62), an engagement and/or disengagement of a brake (as indicated by the at least one brake sensor 64), and/or an establishment and/or release of at least one safety interlock (as indicated by the at least one safety interlock sensor 66), among others. Additional events will be apparent to one having skill in the art.

The monitoring unit 40 is configured to monitor the sensors 52-66 for events, timestamp each event, and store that event and its associated timestamp (collectively, "event information"). In some embodiments, the monitoring unit 40 also indicates connections of external devices, power outages of the truck, low power provided from the truck, the service history of the truck, and an identification of the tank 12, and in particular the trailer that supports the tank 12. The monitoring unit 40 is further configured to provide a permissive signal to the gantry controller 36 through at least one socket 42, 44 to load at least one compartment 14*a*, 14*b*, 14*c*, or 14*d*. In specific embodiments, the monitoring unit 40 will not provide the permissive signal for one or more of the compartments 14*a*, 14*b*, 14*c*, and 14*d* if an overfill condition is present (indicating that there is fluid in a compartment 14*a*, 14*b*, 14*c*, or 14*d* above a first predetermined level), a retain condition is present (indicating that there is fluid in a compartment 14*a*, 14*b*, 14*c*, or 14*d* above a second predetermined level), a brake is not engaged, an API valve to the compartment to be filled is not open, a vapor connection to the compartment to be filled is not open, the truck 10 is not connected to a ground, there is no electrical connection between the monitoring unit 40 and the gantry controller 36, and/or a safety interlock of the truck 10 is not engaged.

Figure 4:
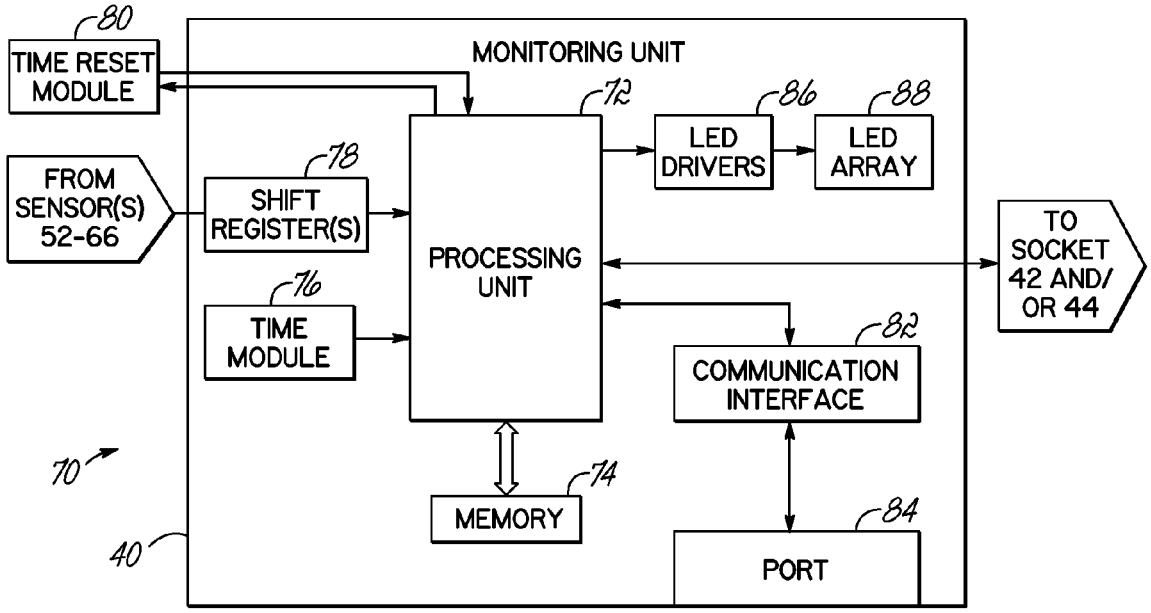
FIG. 4 is a diagrammatic illustration of a schematic of, and couplings to, one embodiment of the monitoring unit of FIG. 2 consistent with embodiments of the invention.

One suitable monitoring unit 40 consistent with embodiments of the invention is a part no. FT208 series monitoring unit as manufactured by DixonBayco. FIG. 4 is a diagrammatic illustration 70 of one embodiment of the monitoring unit 40 consistent with embodiments of the invention. As shown in FIG. 4, the monitoring unit 40 includes a processing unit 72, memory 74, and time module 76. The processing unit 72 may receive signals from the sensors 52-66, process the signals, and, upon detecting an event, timestamp the event with a time from the time module 76 and store the event information in the memory 74. The processing unit 72, in some embodiments, may be a processor, microprocessor, or microcontroller as is well known in the art. In specific embodiments, the processing unit 72 is a part no. PIC18F4685 microcontroller as distributed by Microchip Technology, Inc. ("Microchip"), of Chandler, Ariz. The memory 74, in some embodiments, may be partially and/or fully comprised of electrically erasable programmable read-only memory ("EEPROM"), random access memory ("RAM"), dynamic random access memory ("DRAM"), static random access memory ("SRAM"), flash memory, memristors, hard disk drive, and/or another digital storage medium. In specific embodiments, the memory 74 may be comprised of a plurality of part no. 24LC256 serial EEPROM memory chips as also distributed by Microchip. The time module 76, meanwhile, in some embodiments may be an electronic chip operable to maintain a relatively stable time and communicate that time to the processing unit 72, and in specific embodiments may be a part no. DS1307 real-time clock as distributed by Maxim Integrated Products of Sunnyvale, Calif. ("Maxim").

In some embodiments, monitoring unit 40 may further include at least one shift register 78 to receive the signals from the sensors 52-66 and selectively provide the signals to the processing unit 72. In alternative embodiments, the monitoring unit 40 may include at least one multiplexer (not shown) to receive the signals from the sensors 52-66 and selectively provide the signals to the processing unit 72. The monitoring unit 40 may also be electrically connected to a timer reset module 80 that, in some embodiments, may be a pushbutton that, when activated, provides a timer reset signal to the processing unit 72. In some embodiments, the timer reset signal is interpreted by the processing unit 72 as a command to ignore an event for a period of time. In specific embodiments, the timer reset signal may be interpreted by the processing unit 72 to ignore a retain condition for about forty minutes. In those embodiments, during loading of at least one compartment 14*a*, 14*b*, 14*c*, and 14*d*, the user may activate the timer reset module 80 to prevent a retain condition being declared while loading fluid, thereby maintaining the permissive signal and preventing erroneous cessation of the fluid loading.

The monitoring unit 40 may additionally include a communication interface 82, a communications port 84, LED drivers 86, and an LED array 88 to communicate data about the truck 10 and/or tank 12. The communication interface 82 may provide the ability for the monitoring unit 40 to communicate to an external device through a port 84. In some embodiments, the communication interface 82 may be configured to communicate as specified by American national standard ANSI/TIA/EIA-422. In those embodiments, the communication interface 82 may include a model no. MAX490 full-duplex RS-485/RS-422 transceiver. In alternative embodiments, the communication interface 82 may be configured to communicate through the universal serial bus (USB) 2.0 standard as is well known in the art. As such, the serial port 84 may include connections for EIA-485 communication and/or a USB receptacle, both of which are well known in the art. The processing unit 72 may indicate an event, such as a retain and/or overfill condition of one or more of the compartments 14*a*, 14*b*, 14*c*, or 14*d* through an LED array 88 supplied power and signals from a plurality of LED drivers 86. In some embodiments, LED array 88 includes about twenty-one LEDs, and in specific embodiments the twenty-one LEDs may include eight LEDs to indicate overfill conditions of up to about eight compartments, eight LEDs to indicate retain conditions of up to about eight compartments, one LED to indicate that the monitoring unit 40 is powered on, one LED to indicate whether the monitoring unit 40 is currently supplying the permissive signal, one each of LEDs to indicate the status of the signals to and from at least one sensor, and one LED to indicate a connection of the monitoring unit 40 to an external device. The monitoring unit 40 may include a battery (not shown).

Figure 5:
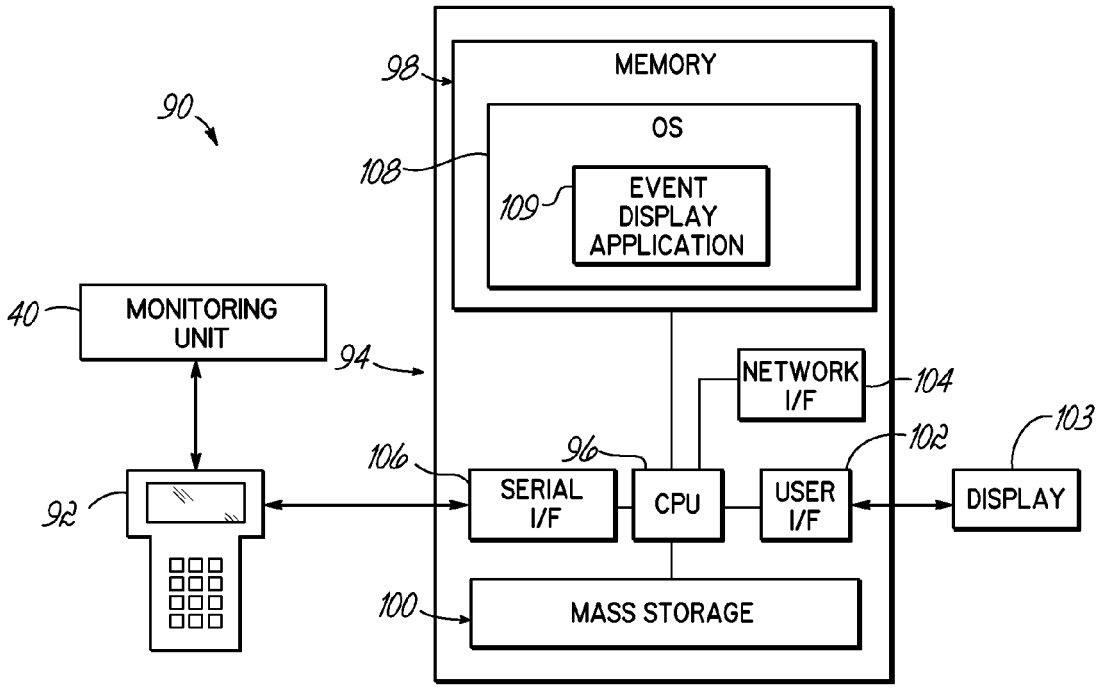
FIG. 5 is a block diagram of one embodiment of a monitoring system to monitor the tanker truck of FIG. 1 that includes the monitoring unit of FIG. 2, a handheld data terminal, and a computer consistent with embodiments of the invention.

FIG. 5 is block diagram of a monitoring system 90 for the tanker truck that includes the monitoring unit 40, a handheld data terminal (hereinafter, "terminal") 92 and a computer 94. In some embodiments, the monitoring unit 40 is configured to communicate with the terminal 92, which may be configured to download information from the monitoring unit 40 as well as upload information to the monitoring unit 40. The terminal 92 may in turn be configured to communicate with the computer 94. Computer 94 may include at least one central processing unit ("CPU") 96 coupled to a memory 98, which may represent the RAM devices comprising the main storage of computer 94, as well as any supplemental levels of memory, e.g., cache memories, nonvolatile or backup memories (e.g., programmable or flash memories), read-only memories, etc. In addition, memory 98 may be considered to include memory storage physically located elsewhere in computer 94, e.g., any cache memory in a processor in CPU 96, as well as any storage capacity used as a virtual memory, e.g., as stored on a mass storage device 100 or on another computer (not shown) coupled to computer 94.

Computer 94 may communicate externally with a user through a user interface 102 that may be attached to one or more user input devices (e.g., a keyboard, a mouse, a trackball, a joystick, a touchpad, and/or a microphone, among others) and a display 103 (e.g., a CRT monitor, an LCD display panel, and/or a speaker, among others). The computer 94 may also communicate externally with another computer through a network (not shown) coupled to computer through a network interface 104. In some embodiments, the network interface 104 may be a wireless network interface as is well known in the art. The computer 94 may communicate with the terminal 92 through a serial interface 106 as is well known in the art. In some embodiments, the computer 94 may communicate with the terminal 92 through a USB interface as is well known in the art. Thus, the computer 94 may download and process the event information from the terminal 92.

Computer 94 operates under the control of an operating system 108, and executes or otherwise relies upon various computer software applications, components, programs, objects, modules, data structures, etc. For example, an event display application 109 may be resident in memory 98 to display the event information received from the terminal 92.

Figure 6:
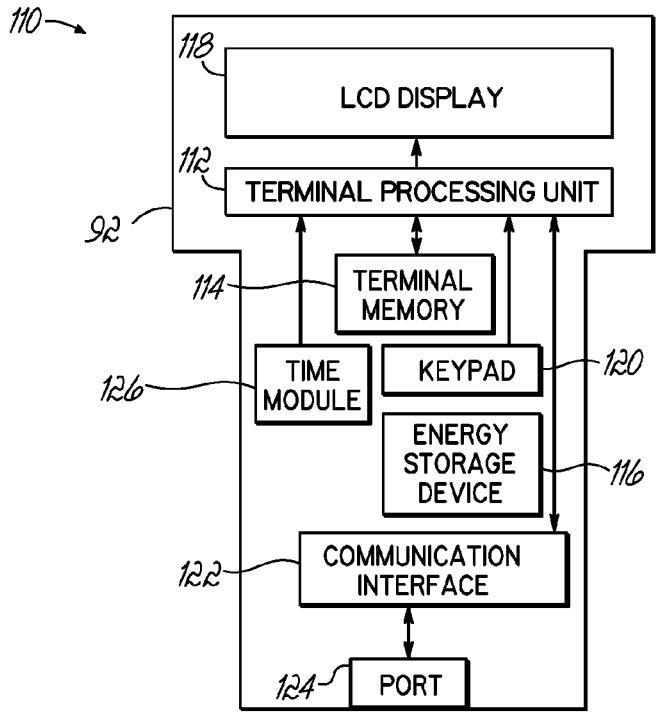
FIG. 6 is a diagrammatic illustration of a schematic of one embodiment of the handheld data terminal of FIG. 5 consistent with embodiments of the invention.

FIG. 6 is a diagrammatic illustration 110 of one embodiment of the terminal 92 consistent with embodiments of the invention to download and display event information from the monitoring unit 40, as well as transfer that event information to the computer 94. The principle components of the terminal 92 include a terminal processing unit 112 coupled to a terminal memory 114. The terminal 92 is powered by an energy storage device 116, such as a battery pack. The terminal processing unit 112, in some embodiments, may be a processor, microprocessor, or microcontroller as is well known in the art. In specific embodiments, the terminal processing unit 112 is a part no. PIC18F4685 microcontroller as distributed by Microchip. The terminal memory 114, in some embodiments, may be partially and/or fully comprised of EEPROM, RAM, DRAM, SRAM, flash memory, memristors, hard disk drive, and/or another digital storage medium. In specific embodiments, the terminal memory 114 may be comprised of a plurality of part no. 24LC1025 CMOS serial EEPROM memory chips as also distributed by Microchip.

The terminal 92 includes a liquid crystal display ("LCD") 118 to display the event information, though one of ordinary skill in the art will recognize that other types of displays may also be used. Thus, after downloading the event information from the monitoring unit 40, a user of the terminal 92 may interact with the keypad 120 to view, scroll through, and acknowledge event information displayed on the LCD display 118. In addition, the user may also interact with the keypad 120 to input data to the terminal for transfer to the monitoring unit 40, such as the type and amount of fluid being loaded to and/or unloaded from each compartment 14*a*, 14*b*, 14*c*, and 14*d*, or to verify the time of the monitoring unit 40 and/or terminal 82. The user may further interact with the keypad 120 to view sensor event data. Thus, the monitoring unit 40 may determine whether it is appropriate to load and/or unload the fluid. In specific embodiments, the LCD display 118 is four-line, twenty-character per line, LCD display as is well known in the art. In some embodiments, the keypad 120 is an about five button keypad as is also well known in the art. The terminal 92 includes at least one communication interface 122 coupled to a port 124 to communicate with the monitoring unit 40. In some embodiments, the communication interface 122 communicates with the monitoring unit through the ANSI/TIA/EIA-422 standard, and communicates with the computer 94 through the USB 2.0 standard. As such, the port 124 may include a port to communicate through the ANSI/TIA/EIA-422 standard and a USB port as is well known in the art. In those embodiments, the communication interface 122 may include both a model no. MAX490 full-duplex RS-485/RS-422 transceiver as distributed by Maxim and a model no. CP2102 USB bridge as distributed by Silicon Laboratories of Austin, Tex. Furthermore, the terminal 82 may include a terminal time module 126 to timestamp events of the terminal 82 (e.g., the time data was downloaded from a monitoring unit 40 or the time data was downloaded to a monitoring unit 40) as well as synchronize time with a monitoring unit 40 (e.g., for example, when first connecting with a monitoring unit 40 or otherwise configuring or setting up a monitoring unit 40). The time module 126, in some embodiments may be an electronic chip operable to maintain a relatively stable time and communicate that time to the terminal processing unit 112, and in specific embodiments may be a part no. DS1307 real-time clock as distributed by Maxim.

In operation, and with reference to FIG. 5 and FIG. 6, the monitoring unit 40 may detect an event, store an indication of the event, and timestamp that indication. The stored and timestamped indication may be referred to as "event information." When the monitoring unit 40 connects with the terminal 92, the operator may be provided with the opportunity to download the event information from the monitoring unit 40 to the terminal 92. The operator may also be provided with the opportunity to input data to the terminal 92 to transfer to the monitoring unit 40, such as the current time or other programming data. When the operator downloads the event data, the operator may view and scroll through the event information using the terminal 92. Thus, the operator may be able to troubleshoot events, errors, and other conditions of the truck 10 by viewing the event information on the terminal 92 display 118. After downloading the event data (e.g., after one event data download from the monitoring unit 40, after a plurality of event data downloads from the monitoring unit 40, or after a plurality of event data downloads from a plurality of monitoring units 40), the operator may connect the terminal 92 to the computer 94 to transfer the event information from the terminal 92 to the computer 94. The event information may be stored on the computer 94 as well as displayed on the display 103 of the computer 94.

Figure 7:
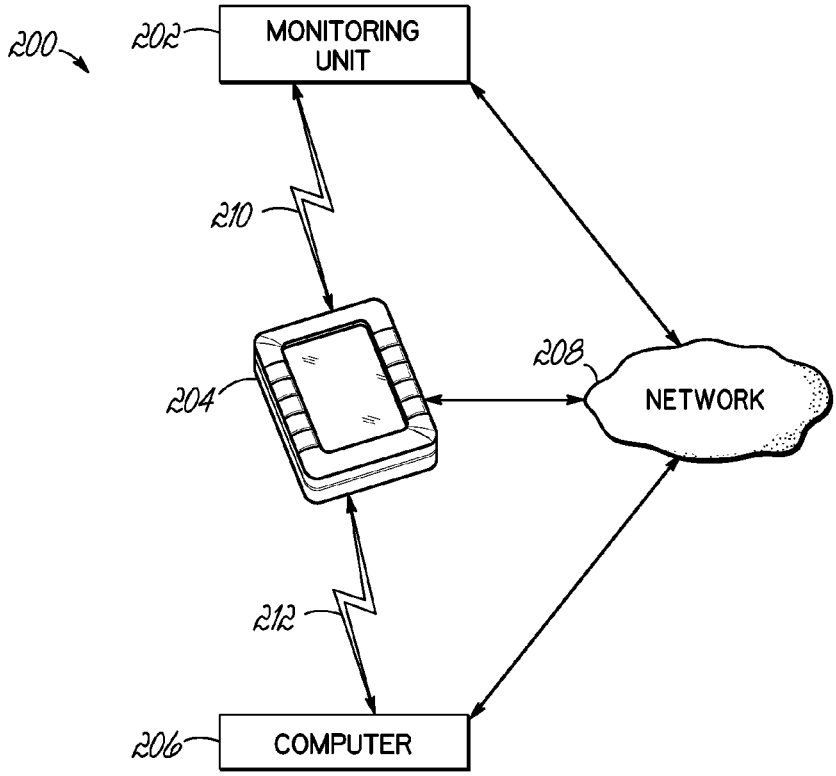
FIG. 7 is a block diagram of an alternative embodiment of a monitoring system to monitor the tanker truck of FIG. 1 that includes a monitoring unit, a handheld data terminal, and the computer consistent with embodiments of the invention.

Although the monitoring system 40, terminal 92, and computer 94 have been described with various components, and have been described as communicating in particular manners, advantages and modifications may be incorporated without departing from the scope of the invention. For example, FIG. 7 is a block diagram of an alternative embodiment of a monitoring system ("system") 200 for a tanker truck 10 consistent with embodiments of the invention. In this embodiment, the system 200 includes a monitoring unit 202, handheld data terminal ("terminal") 204, and computer 206 operable to communicate through at least one network 208. In some embodiments, the computer 206 in FIG. 7 is substantially similar to computer 94 illustrated in FIG. 5.

In some embodiments, the monitoring unit 202 may monitor a truck 10 and/or tank 12 for events, timestamp and store indications of each event, and determine and store the location of the truck 10. The monitoring unit 202 may be configured to transfer the event, timestamp, and location information ("event information") to the terminal 204 through the network 208 or through a first local connection 210. The network 208 may be a long range wireless network, while the first local connection 210 may be a direct electrical connection between the monitoring unit 202 and the terminal 204 or a local low-power wireless connection. The terminal 204, in turn, may be configured to display the event information and be interfaced by a user of the terminal 204 to view the event data and input information to the monitoring unit 202. The terminal 204 may be further configured to transfer the event information to the computer 206 through the network 208 or through a second local connection 212. The second local connection 212, in a similar manner to the first local connection 210, may be a direct electrical connection between the terminal 204 and the computer 206 or a local low-power wireless connection. Furthermore, the monitoring unit 202 may be configured to communicate directly to the computer 206 through network 208.

Figure 8:
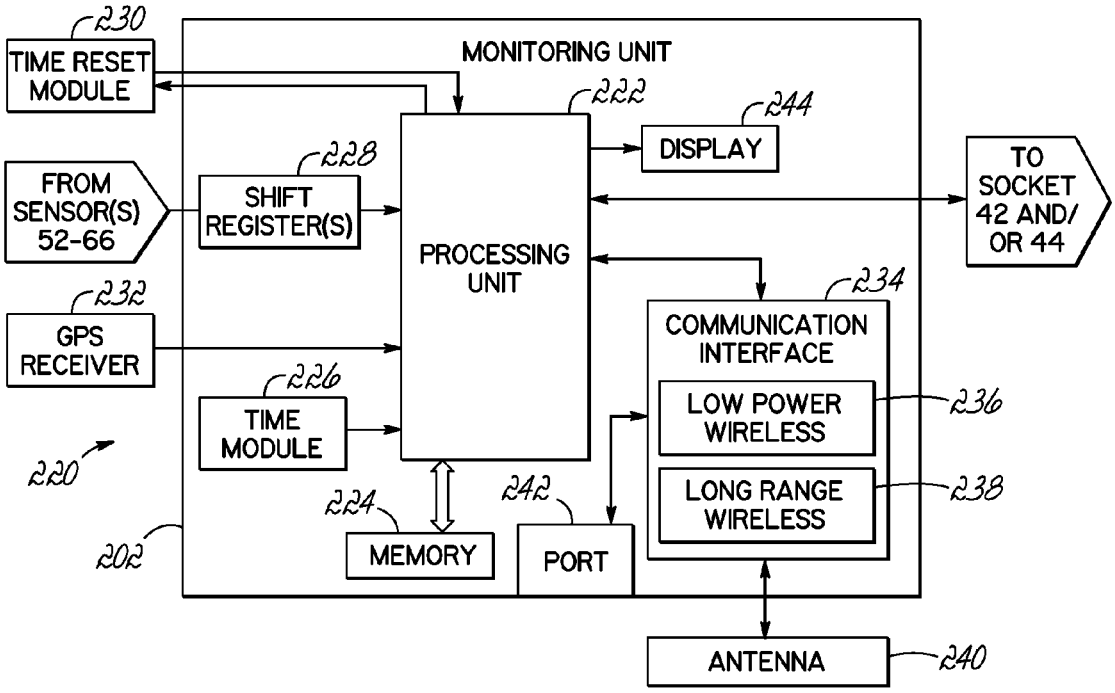
FIG. 8 is a diagrammatic illustration of a schematic of, and couplings to, one embodiment of the monitoring unit of FIG. 7 consistent with embodiments of the invention.

FIG. 8 is a diagrammatic illustration 220 of an alternate embodiment of the monitoring unit 202 for the system 200 of FIG. 7 consistent with embodiments of the invention. Returning to FIG. 8, the monitoring unit 202 may include a processing unit 222, memory 224, and a time module 226. In a similar manner to the monitoring unit 40 of FIGS. 2-5, the monitoring unit 202 illustrated in FIG. 8 may receive signals from the sensors 52-66, process the signals, and, upon detecting an event, timestamp the event with a time from the time module and store the event and timestamp information ("event information") in the memory 224. The processing unit 222, in some embodiments, may be a processor, microprocessor, or microcontroller as is well known in the art, while the memory 224 may be partially and/or fully comprised of EEPROM, RAM, DRAM, SRAM, flash memory, memristors, hard disk drive, and/or another digital storage medium. In a similar manner to the monitoring unit 40 of FIGS. 2-5, in specific embodiments the processing unit 222 may be a part no. PIC18F4685 microcontroller as distributed by Microchip, while the memory 224 may be comprised of a plurality of part no. 24LC256 serial EEPROM memory chips as also distributed by Microchip. The time module 226, in some embodiments, may be an electronic chip operable to maintain a relatively stable time and communicate that time to the processing unit 222, and in specific embodiments may be a part no. DS1307 real-time clock as distributed by Maxim.

In some embodiments, the monitoring unit 222 may further include at least one shift register 228 to receive the signals from the sensors 52-66 and selectively provide the signals to the processing unit 222. In alternative embodiments, the monitoring unit may include at least one multiplexer (not shown) to receive the signals from the sensors 52-66 and selectively provide the signals to the processing unit 222. The monitoring unit 202 may also be electrically connected to a timer reset module 230 that, in some embodiments, may be a pushbutton that, when activated, provides a timer reset signal to the processing unit 222. In some embodiments, the timer reset signal is interpreted by the processing unit 222 as a command to ignore an event for a period of time. In specific embodiments, the timer reset signal may be interpreted by the processing unit 222 to ignore a retain condition for about forty minutes. In those embodiments, during loading of at least one compartment 14*a*, 14*b*, 14*c*, and 14*d*, the user may activate the timer reset module 230 to prevent a retain condition being declared while loading fluid, thereby maintaining the permissive signal and preventing erroneous cessation of the fluid loading.

The monitoring unit 202 may also receive a signal from a global positioning satellite ("GPS") receiver 232 disposed on the truck 10 that indicates the current GPS position of the truck 10. Thus, the processing unit 222 may receive an indication of its current location. In some embodiments, the processing unit 222 determines the GPS location in response to detecting an event, while in alternative embodiments the processing unit 222 determines the GPS location of the truck 10 at periodic intervals, such as about every forty seconds. In further specific embodiments, the monitoring unit 202 may determine the GPS location of the truck 10 and/or tank each time a valve assembly sensor 56 indicates that an API valve is open. Throughout the embodiments, the processing unit 222 may store the GPS location as event information.

The monitoring unit 222 may additionally include a communication interface 234 that may further include a low power wireless interface 236 and a long range wireless interface 238. The low power wireless interface 236 may communicate with other devices, such as the handheld data terminal 204 or the computer 206, through a low-power wireless communication standard, such as BlueTooth, while the long range wireless interface 238 may communicate with other devices through a higher power wireless communication standard, such as Global System for Mobile communications ("GSM") (including Enhanced Data rates for GSM Evolution, or "EDGE"), Universal Mobile Telecommunications System ("UMTS"), Code Division Multiplex Access "(CDMA") (including CDMA2000), and/or another first generation, second generation, third generation, pre-fourth generation, radio, cellular and/or satellite wireless communication standard as is well known in the art. As such, the monitoring unit 202 may include at least one antenna 240 to connect to the communication interface 234, low power wireless interface 236, and or long range wireless interface 238. In specific embodiments, the at least one antenna 240 may include a first antenna to communicate through the low power wireless interface 236 and a second antenna to communicate through the long range wireless interface 238. In further specific embodiments, the second antenna may be a satellite communications transceiver as is well known in the art. The communication interface 234 may further include a USB 2.0 transceiver as is well known in the art. As such, the monitoring unit 202 may further include a port 242, such as a USB port, to communicate serially between the monitoring unit 202 and other devices.

In some embodiments, the monitoring unit 202 includes a display 244 to display truck 10 and or tank 12 status, as well as event information, to an operator. In some embodiments, the display 244 includes LED drivers 86 and an LED array 88 similar to the monitoring unit 40 of FIGS. 2-5. Returning to FIG. 8, in alternative embodiments, the display 244 may be a video display that may display a diagrammatic representation of the truck 10, including the status of each compartment 14*a*, 14*b*, 14*c*, or 14*d* of the tank 12, and event information. In further alternative embodiments, the display 244 may be a touch-screen display operable to display video and receive operator input. In these further alternative embodiments, the monitoring unit 222 may not include the time reset module 230 and may receive data associated with the type and amount of fluid being loaded to and/or unloaded from the tank 12 through the display 244.

Figure 9:
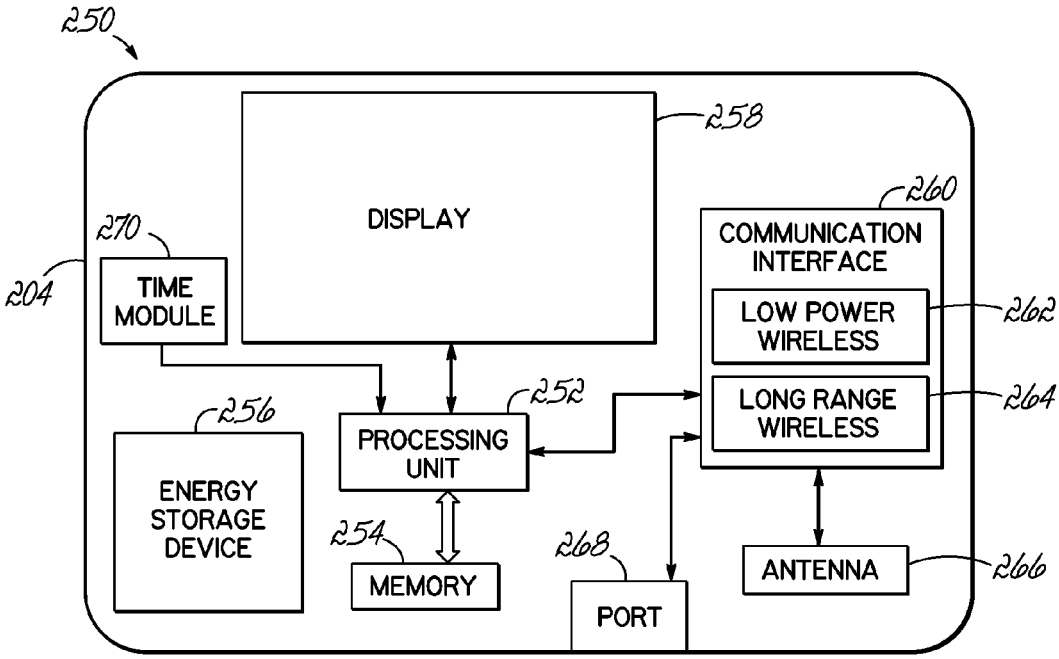
FIG. 9 is a diagrammatic illustration of a schematic of one embodiment of the handheld data terminal of FIG. 7 consistent with embodiments of the invention.

FIG. 9 is a diagrammatic illustration 250 of an alternate embodiment of the terminal 204 for the system 200 of FIG. 7 consistent with embodiments of the invention. The terminal 204 may include a terminal processing unit 252 coupled to a terminal memory 254. The terminal 204 may be powered by an energy storage device 256, such as a battery pack. The terminal processing unit 252, in some embodiments, may be a processor, microprocessor, or microcontroller as is well known in the art, while the terminal memory 254 may be partially and/or fully comprised of EEPROM, RAM, DRAM, SRAM, flash memory, memristors, hard disk drive, and/or another digital storage medium.

The terminal 204 includes a display 258 to display truck 10 status and/or event information, to a user. In some embodiments, the display 258 is a touch-screen display that may receive operator input and display a diagrammatic representation of the truck 10, including the status of each compartment 14*a*, 14*b*, 14*c*, or 14*d* of the tank 12, and event information. After downloading the event information from the monitoring unit 202, the user may interact with the display 258 to view and scroll through event information. The user may also interact with the display 258 to input data associated with the type and amount of fluid being loaded to and/or unloaded from the tank 12, to the monitoring unit 202.

To interact with the monitoring unit 202, as well as transfer the event information to the computer 206, the terminal 204 may include a communication interface 260 that further includes a low power wireless interface 262 and a long range wireless interface 264. The low power wireless interface 262 may communicate with other devices, such as the monitoring unit 202 or computer 204, through a low-power wireless communication standard, such as BlueTooth, while the long range wireless interface 264 may communicate with other devices through a higher power wireless communication standard, such as GSM (including EDGE), UMTS, CDMA (including CDMA2000), and/or another first generation, second generation, third generation, pre-fourth generation, radio, cellular, and/or satellite wireless communication standard. As such, the terminal 204 may include at least one antenna 266 to receive and/or transmit signals to and/or from the communication interface 262. In specific embodiments, the at least one antenna 266 may include a first antenna to communicate through the low power wireless interface 262 and a second antenna to communicate through the long range wireless interface 264. The communication interface 260 may further include a USB transceiver as is well known in the art. As such, the terminal 204 may further include a port 268, such as a USB port, to communicate serially between the terminal 204 and other devices. Moreover, the terminal 204 may include a time module 270 to maintain a relatively stable time and communicate that time to the terminal processing unit 252, and in specific embodiments may be a part no. DS1307 real-time clock as distributed by Maxim.

Figure 10:
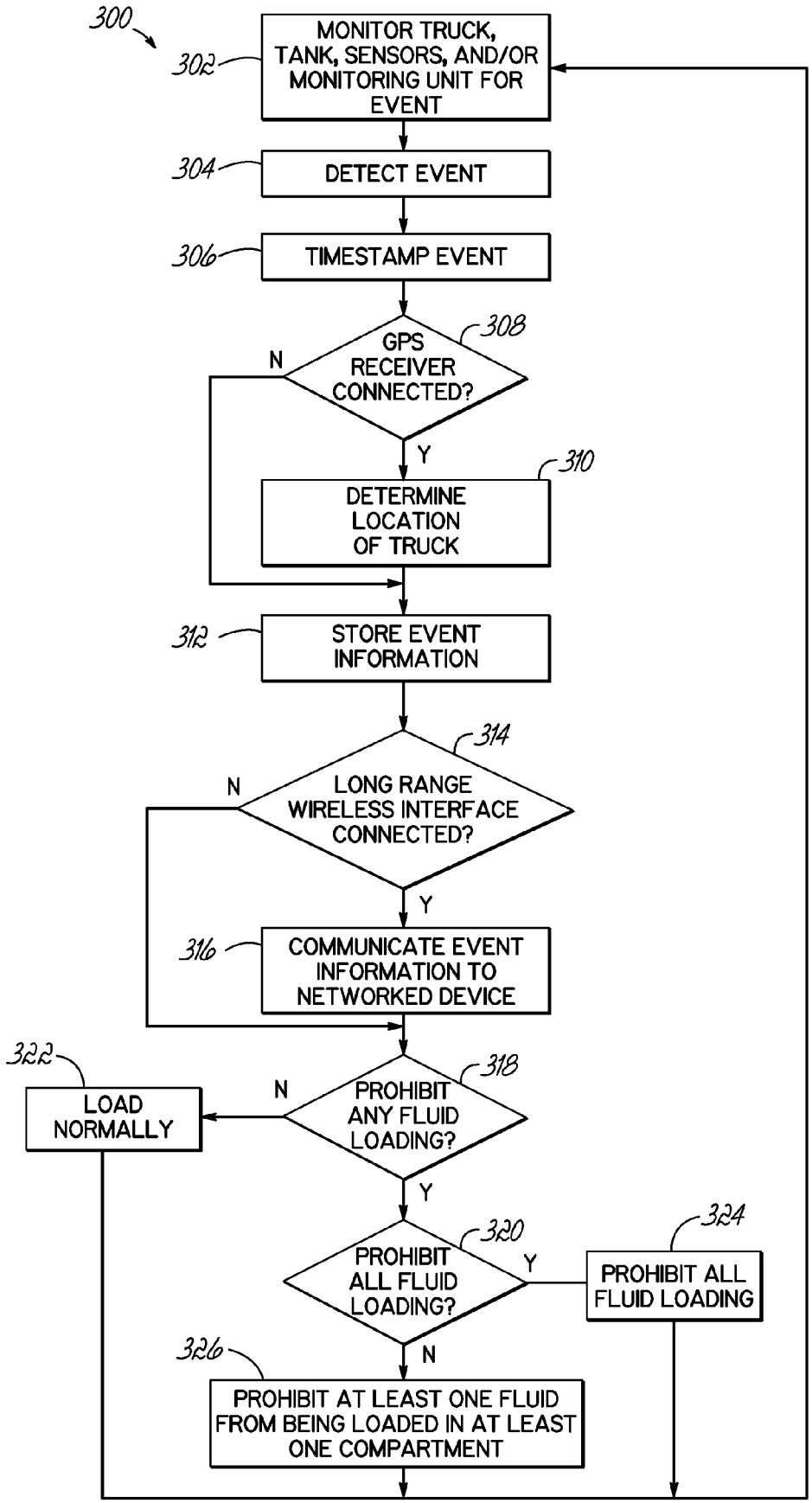
FIG. 10 is a flowchart illustrating a process of the monitoring unit of FIG. 2 and/or FIG. 7 to detect events and determine actions based on those events.

Flowchart 300 in FIG. 10 illustrates a method for a monitoring system consistent with embodiments of the invention to monitor a tanker truck. The monitoring system may include a monitoring unit coupled with a plurality of sensors to monitor the truck, tank, and/or connections to the monitoring unit for an event (block 302). When the monitoring unit detects an event (block 304) it also timestamps the event (block 306). The timestamp may include an indication of the time and date the event occurred.

After the event is timestamped, the monitoring unit may determine if a GPS receiver is connected (block 308). When a GPS receiver is connected, the monitoring unit may determine the GPS location of the truck ("Yes" branch of decision block 310). The monitoring unit may then store the event, the timestamp information, and/or the GPS location of the monitoring unit at the time of the event as event information (block 312). When it is determined that there is no GPS receiver connected to the monitoring unit ("No" branch of decision block 310) or after the determination of the location of the truck (block 310), the monitoring unit stores the event and timestamp information as event information (block 312). Alternatively, instead of determining the GPS location of the truck in response to an event, the monitoring unit may determine the GPS location of the truck at a set time interval, such as about every forty seconds.

The monitoring unit may then determine if a long range wireless interface is coupled to the monitoring unit (block 314). When a long range wireless interface is connected to the monitoring unit ("Yes" branch of decision block 314), the monitoring unit may communicate the event information across the network to a networked device, such as a handheld data terminal or computer (block 316).

After communication of the event to the networked device (block 316) or the determination that there is no long range wireless interface connected to the monitoring unit ("No" branch of decision block 314), the monitoring unit may determine whether the event should prohibit any fluid loading (block 318). When the event should prohibit fluid loading of some sort, for example, of a particular fluid or of a particular compartment ("Yes" branch of block 318) the monitoring unit determines whether to prohibit all fluid loading (block 320). When the event should not prohibit fluid loading of some sort ("No branch of block 318), the monitoring unit outputs a permissive signal with no restrictions that allows a gantry controller to load compartments of the tanker truck normally (block 322).

When the monitoring unit determines that all fluid loading should be prohibited ("Yes" branch of decision block 320), the monitoring unit prohibits a permissive signal to fill any of the compartments (block 324). In specific embodiments, the monitoring unit prohibits the loading of a first fluid in a first compartment and prohibits the loading of the first fluid in a second compartment, or the monitoring unit prohibits the loading of a first fluid in a first compartment and prohibits the loading of a second fluid in a second compartment. When the monitoring unit determines that all fluid loading should not be prohibited ("No" branch of decision block 320), the monitoring unit outputs a permissive signal for at least one fluid and for at least one compartment (block 326). In specific embodiments, the monitoring unit outputs a permissive signal that prohibits the loading of a first fluid in the first compartment while permitting the loading of the first fluid in a second compartment, or the permissive signal prohibits the loading of a first fluid in the first compartment while permitting the loading of a second fluid in a second compartment. After outputting the permissive signal with or without restrictions (blocks 326 and 322, respectively, or prohibiting the permissive signal (block 324), the monitoring unit may return to monitor the truck, tank, sensors, or monitoring unit to detect an event (block 302).

Figure 11:
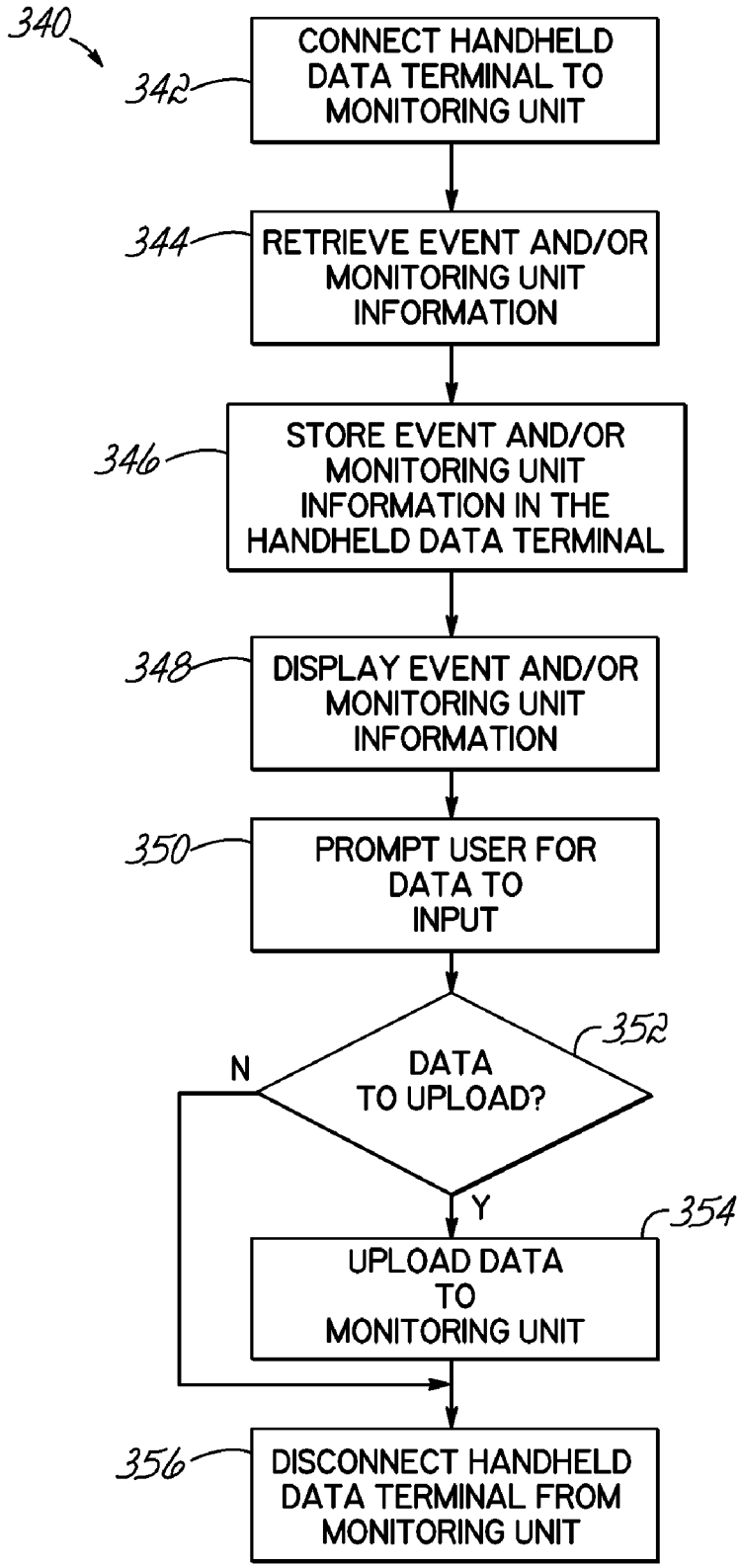
FIG. 11 is a flowchart illustrating a process of the handheld data terminal of FIG. 5 and/or FIG. 7 to retrieve event information from and/or transfer data to the monitoring unit of FIG. 2 and/or FIG. 7, respectively, consistent with embodiments of the invention.

Flowchart 340 in FIG. 11 illustrates a method for connecting a handheld data terminal to the monitoring unit to retrieve event and monitoring unit information from, and/or input programming information to, the monitoring unit consistent with embodiments of the invention. The handheld data terminal may be connected to the monitoring unit through serial communications or through a wireless network (block 342). In some embodiments, the monitoring unit may declare the connection of the monitoring unit to the handheld data terminal as an event. In response to being connected to the monitoring unit, the handheld data terminal may automatically retrieve event and monitoring unit information from a memory of monitoring unit (block 344), store that event and monitoring unit information (block 346), and display at least a portion of the event and monitoring unit information (block 348). In alternative embodiments, the handheld data terminal may prompt a user to download event and monitoring unit information and, in response to the user requesting to download the event and monitoring unit information, retrieve the event and monitoring unit information from the monitoring unit (block 344). In alternative embodiments, the handheld data terminal may allow a user to scroll through event and monitoring unit information while displaying the event information (block 348). The event information may include an identification of the event, a timestamp of the event, and the GPS location of the tank at the time of the event. The monitoring unit information may include an indication of the number and type of sensors the monitoring unit is coupled with, a time for the monitoring unit to ignore particular events in response to activation of the timer reset module and/or user interaction, the firmware version of the monitoring unit, and/or a unique identification for the tanker truck and/or monitoring unit.

The handheld data terminal may be used to input data to the monitoring unit. This data may include the number of compartments monitored by the monitoring unit, the number and types of sensors connected to the monitoring unit, a unique identification of the monitoring unit and/or tanker truck, new firmware for the monitoring unit, a time to ignore at least one event after detecting a timer reset signal from a timer reset module and/or user interaction, and/or fuel information. As such, the handheld data terminal may prompt a user for data to input to the monitoring unit (block 350). The handheld data terminal may then determine whether there is data to upload to the monitoring unit (block 352). When the handheld data terminal determines that there is data to upload to the monitoring unit ("Yes" branch of decision block 352), the handheld data terminal uploads the data to the monitoring unit (block 354). When the handheld data terminal determines that there is not data to upload to the monitoring unit ("No" branch of decision block 352), or after uploading data to the monitoring unit (block 354), the handheld data terminal may disconnect from the monitoring unit (block 356).

Figure 12:
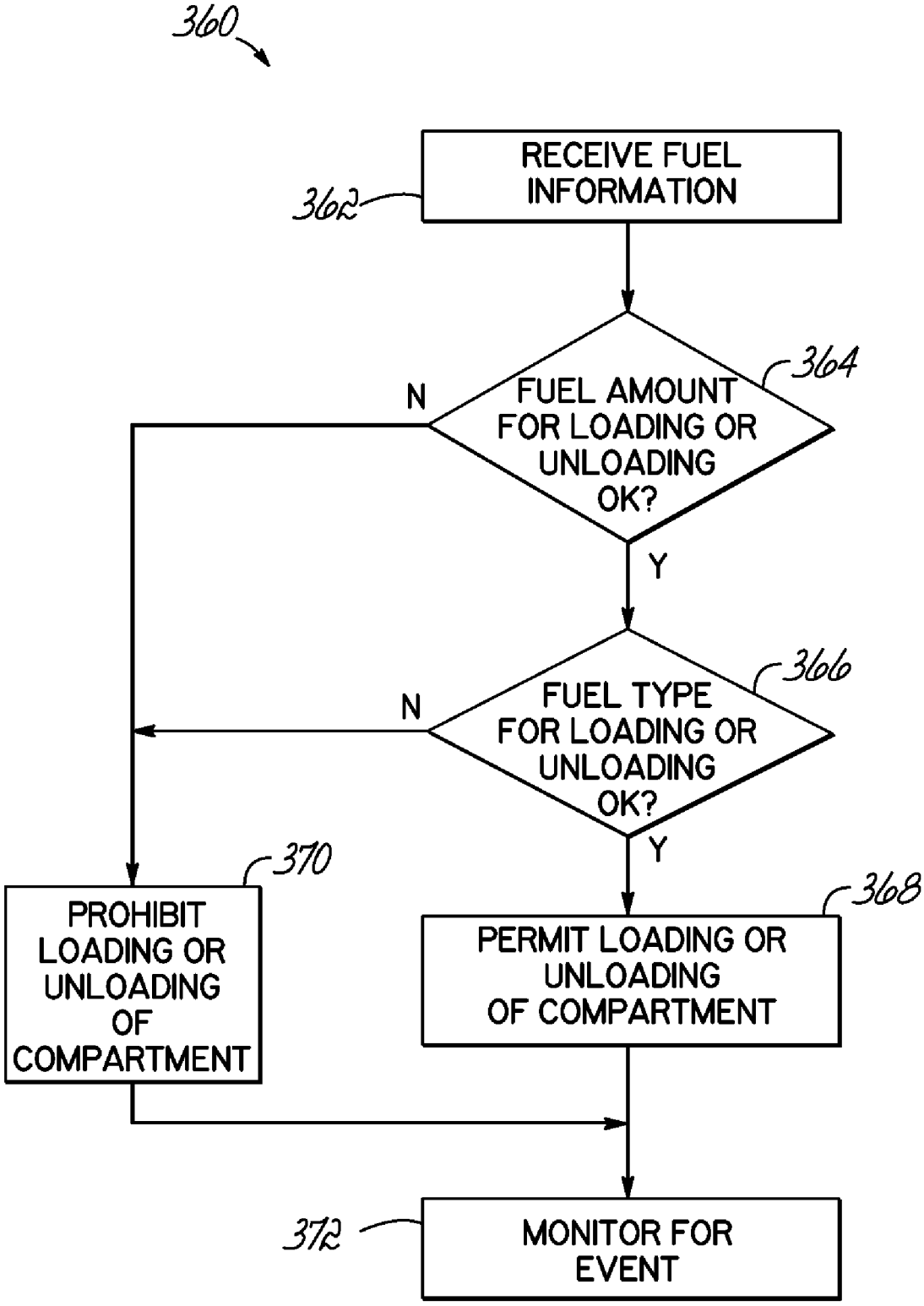
FIG. 12 is a flowchart illustrating a process to process data received from the handheld data terminal of FIG. 5 and/or FIG. 7 in the monitoring unit of FIG. 2 and/or FIG. 7, respectively, consistent with embodiments of the invention.

Flowchart 360 in FIG. 12 illustrates a method to allow loading and/or unloading of a compartment of a tanker truck by analyzing data received by the monitoring unit consistent with embodiments of the invention. In specific embodiments, the tanker truck is a fuel tanker truck, the fluid is a fuel, and the data includes fuel information. In some embodiments, fuel information may include data about the fuel type (i.e., unleaded gasoline with 87/88/89/90/91 octane, diesel fuel, kerosene, etc.), the fuel amount (i.e., up to about 9000 gallons), the compartment that each fuel type is to be loaded to when the tank is configured with more than one compartment, and the fuel type in a supply tank the compartment is to be unloaded into. Thus, by analyzing the fuel information, the monitoring unit may prevent erroneously mixing different types of fuel in a compartment into a "cocktail," mixing different types of fuel in a supply tank into a cocktail, overfilling of a compartment, or loading of a compartment that should otherwise not be loaded. To determine whether to allow the loading and/or unloading of the compartment, the monitoring unit first receives fuel information (block 362). The fuel information may include the type of fuel, the amount of fuel, the compartment that is to be configured with that type and amount, and/or the type of fuel in a supply tank that compartment is to be unloaded to. Thus, the monitoring unit may determine whether the fuel amount to load or unload is acceptable (block 364). For example, the monitoring unit may determine how much fuel is in a compartment to be loaded, and whether that compartment contains room for the fuel to be loaded. Also for example, the monitoring unit may determine how much fuel is a supply tank to the fuel in a compartment into, and whether that supply tank contains room for the fuel to be unloaded Thus, the monitoring unit may determine that the fuel amount is unacceptable when there is not enough room to load or unload the desired amount of fuel ("No" branch of block 364), and determine that the fuel amount is acceptable when there is enough room to load or unload the desired amount of fuel ("Yes" branch of block 364).

When the compartment determines that the amount of fuel is acceptable ("Yes" branch of block 364), the monitoring unit may determine whether the type of fuel to load or unload is acceptable (block 366). For example, the monitoring unit may determine the type of fuel in the compartment, if any, and whether the type of fuel in the compartment matches the type of fuel to be loaded to the compartment. Also for example, the monitoring unit may determine the type of fuel in the compartment, and whether that type of fuel is the same as the type of fuel in a supply tank in which to unload that compartment. When the fuel amount to load or unload is acceptable ("Yes" branch of decision block 364) and the fuel type to load or unload is acceptable ("Yes" branch of decision block 366), the monitoring unit may permit loading or unloading (block 368). In some embodiments, the monitoring unit may output a permissive signal to load the compartment.

When the fuel amount to load or unload is unacceptable ("No" branch of decision block 364), or the fuel type to load or unload is unacceptable ("No" branch of decision block 366), the monitoring unit may prohibit loading or unloading (block 370). In some embodiments, the monitoring unit may prohibit a permissive signal to load the compartment, or declare an event that the compartment should not be unloaded. After permitting loading or unloading of the compartment (block 368), or prohibiting loading or unloading of the compartment (block 370) the monitoring unit may continue to monitor the tanker truck for an event (block 372). One having ordinary skill in the art will appreciate that although flowchart 360 illustrates a method for determining whether to allow loading or unloading of a compartment of the tank of the tanker truck, the method illustrated in flowchart 360 is applicable to a tank having a single compartment, or the method may be iterated for a tank having a plurality of compartments.

Figure 13:
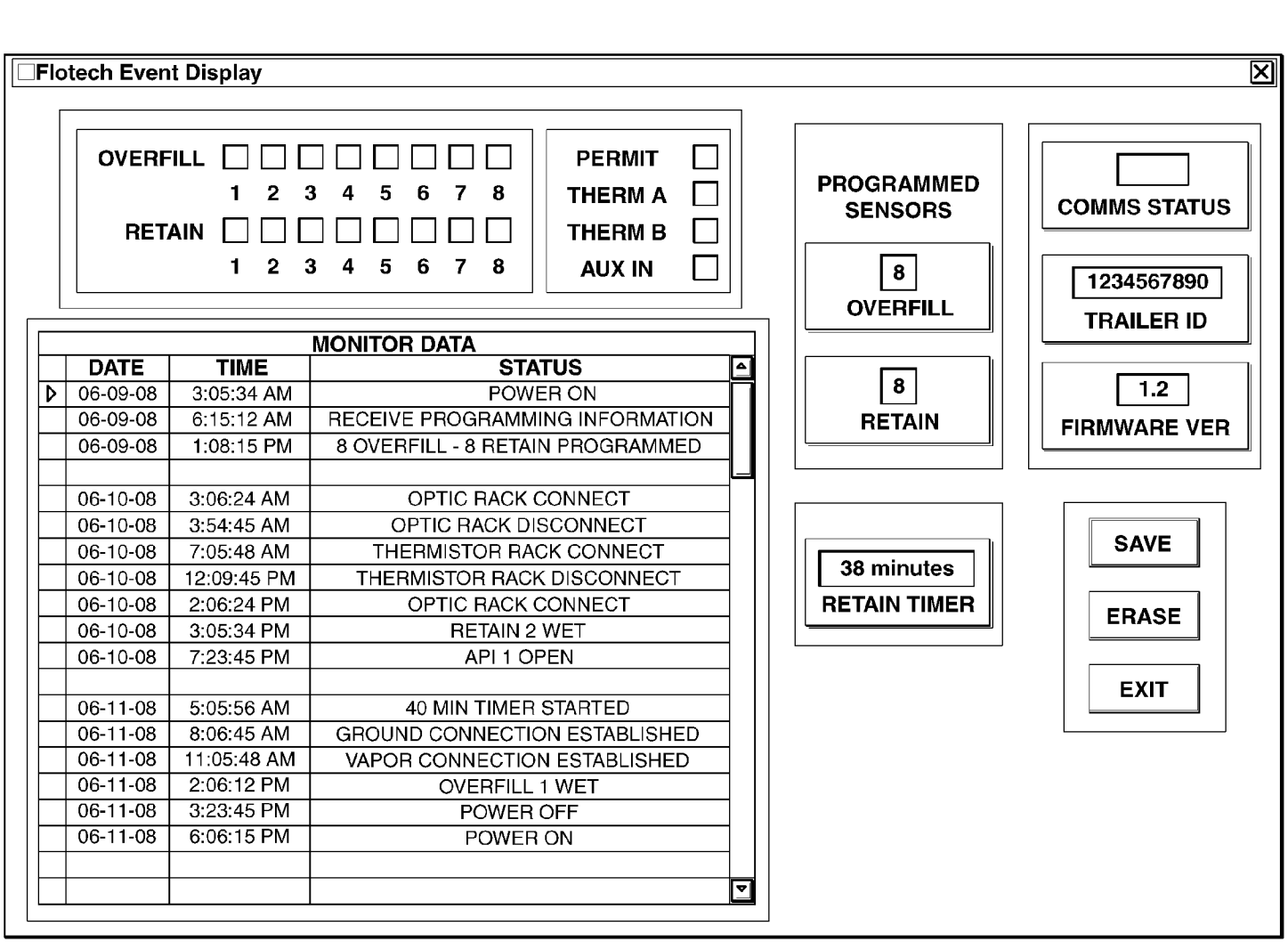
FIG. 13 is a block diagram of one embodiment of an event screen displayed by the monitoring system of FIG. 5 and/or FIG. 7 to display event and/or monitoring unit information.

The handheld data terminal may display event and monitoring unit information, as well as transfer the event information to a computer through serial communications or a wireless network. In turn, the computer may be configured with an event display application to display the event and monitoring unit information. FIG. 13 is a block diagram of one embodiment of an event screen 380 displayed by the computer to allow a user to view event and monitoring unit information. Additionally, and/or alternatively, in some embodiments the handheld data terminal may be configured to display the event screen 380. The event screen 380 allows the user to view events and monitoring unit information, including events and their timestamps, information about the sensors connected to the monitoring unit, a unique identification of the tanker truck and/or monitoring unit, firmware versions of the monitoring unit, and/or the timer to ignore particular events.

While the present invention has been illustrated by a description of the various embodiments and the examples, and while these embodiments have been described in considerable detail, it is not the intention of the applicants to restrict or in any way limit the scope of the appended claims to such detail. Additional advantages and modifications will readily appear to those skilled in the art. Thus, the invention in its broader aspects is therefore not limited to the specific details, representative apparatus, and method. In particular, although some aspects of some embodiments of the invention have been described in connection with fuel tanker trucks, one having ordinary skill in the art will appreciate that some embodiments of the invention are applicable to any tanker truck configured to transport a fluid. Moreover, one having ordinary skill in the art will appreciate that the handheld data terminal and computer may be incorporated together, and in some embodiments may be a tablet computer as is well known in the art. Accordingly, departures may be made from such details without departing from the scope of applicants' general inventive concept.

What is claimed is:

1. A method of monitoring a tanker truck with a monitoring system that includes a monitoring unit and a handheld data terminal, the monitoring unit of the type that includes a processing unit, a time module, and a memory, the method comprising:

monitoring the tanker truck with the monitoring unit to detect an occurrence of an event, the tanker truck having multiple compartments, each compartment configured to retain a liquid fuel and including a cover, a vapor recovery fitting, a pipe in fluid communication with the compartment, and a valve assembly coupled to the pipe, the valve assembly being configured to allow loading of liquid fuel to and unloading of liquid fuel from the compartment through the pipe;

in response to detecting the event, time stamping the detected event and storing the detected and time stamped event in the memory of the monitoring unit;

retrieving the stored event from the memory of the monitoring unit with the handheld data terminal; and displaying the retrieved event on a display on the handheld data terminal.

2. The method of claim 1, wherein the event includes an event selected from the group consisting of an overfill of a fluid in a compartment of the tanker truck, a retention of the fluid in the compartment of the tanker truck, and combinations thereof.

3. The method of claim 1, wherein the event includes an event selected from the group consisting of engagement of a brake of the fluid tanker truck, disengagement of the brake of the fluid tanker truck, engagement of a plurality of safety interlocks of the tanker truck, disengagement of the plurality of safety interlocks of the tanker truck, and combinations thereof.

4. The method of claim 1, wherein the event includes an event selected from the group consisting of opening an American Petroleum Institute (API) valve associated with a compartment of the tanker truck, closing the API valve associated with the compartment of the tanker truck, and combinations thereof.

5. The method of claim 1, wherein the event includes an event selected from the group consisting of establishing a vapor connection with a compartment of the tanker truck, losing a vapor connection with the compartment of the tanker truck, and combinations thereof.

6. The method of claim 1, wherein the event includes an event selected from the group consisting of establishing an electrical connection between the monitoring unit and a gantry controller, losing the electrical connection between the monitoring unit and the gantry controller, establishing a ground connection between the tanker truck and a ground, losing the ground connection between the tanker truck and the ground, and combinations thereof.

7. The method of claim 1, wherein the event includes an event selected from the group consisting of powering off the monitoring unit, powering on the monitoring unit, resetting the monitoring unit, connecting the monitoring unit to the handheld data terminal, communicating between the monitoring unit and the handheld data terminal, programming the monitoring unit with the handheld data terminal, and combinations thereof.

8. The method of claim 1, wherein the monitoring unit includes an external communications port, wherein the handheld data terminal includes a monitoring unit communications port and a memory, and wherein retrieving the stored event data from the monitoring unit with the handheld data terminal further comprises:

connecting the monitoring unit communications port to the external communications port; and retrieving the stored event from the memory of the monitoring unit to the memory of the handheld data terminal.

9. The method of claim 8, wherein the handheld data terminal includes a user interface, the method further comprising:

receiving data from the user interface; and uploading that data to the monitoring unit.

10. The method of claim 1, wherein the monitoring unit includes a wireless communications interface, wherein the handheld data terminal includes a wireless communications interface and a memory, and wherein retrieving the stored event data from the monitoring unit with the handheld data terminal further comprises:

wirelessly transferring the stored event from the memory of the monitoring unit to the memory of the handheld data terminal.

11. The method of claim 10, wherein the handheld data terminal includes a user interface, the method further comprising:

receiving data from the user interface; and uploading that data to the monitoring unit.

12. The method of claim 1, wherein the monitoring unit includes a global positioning system receiver, the method further comprising:

tracking the location of the tanker truck.

13. The method of claim 12, wherein tracking the location of the tanker truck further comprises:

periodically determining the location of the tanker truck and storing the determined location.

14. The method of claim 12, the method further comprising:

in response to detecting the event, determining the location of the tanker truck and storing the determined location in the memory of the monitoring unit.

15. The method of claim 14, wherein the monitoring system further includes a computer, the method further comprising:

communicating the stored location and the stored event to the computer across a wireless data network.

16. The method of claim 14, wherein retrieving the stored event further comprises:

retrieving the stored location from the monitoring unit with the handheld data terminal.

17. The method of claim 1, wherein the tanker truck includes a plurality of compartments, each compartment configured to retain a fluid, and wherein the event is associated with a first compartment from among the plurality of compartments, the method further comprising:

in response to detecting the event, prohibiting the loading of a first fluid in the first compartment and prohibiting the loading of the first fluid in a second compartment from among the plurality of compartments.

18. The method of claim 1, wherein the tanker truck includes a plurality of compartments, each compartment configured to retain a fluid, and wherein the event is associated with a first compartment from among the plurality of compartments, the method further comprising:

in response to detecting the event, prohibiting the loading of a first fluid in the first compartment while permitting the loading of the first fluid in a second compartment from among the plurality of compartments.

19. The method of claim 1, wherein the tanker truck includes a plurality of compartments, each compartment configured to retain a fluid, and wherein the event is associated with a first compartment from among the plurality of compartments, the method further comprising:

in response to detecting the event, prohibiting the loading of a first fluid in the first compartment while permitting the loading of a second fluid in a second compartment from among the plurality of compartments.

20. The method of claim 1, wherein the tanker truck is configured with at least one compartment configured to retain a fluid, the method further comprising:

in response to the event, withholding a permissive signal that permits loading of the at least one compartment with the fluid.

21. The method of claim 20, wherein the monitoring unit includes a timer button, and wherein the event is a retention of the fluid in the compartment of the tanker truck, the method further comprising:

in response to detecting a depression of the timer button, ignoring the event for a predetermined time and providing the permissive signal to permit loading of the at least one compartment with the fluid.

22. The method of claim 1, wherein the monitoring system further includes a computer, the method further comprising:

transmitting the stored event from the handheld data terminal to the computer; and displaying the stored event on a display of the computer.

23. A monitoring system for a tanker truck, the tanker truck including at least one compartment to retain a liquid fluid, each compartment including a cover, a vapor recovery fitting, a pipe in fluid communication with the compartment, and a valve assembly coupled to the pipe, the valve assembly being configured to allow loading of liquid fuel to and unloading of liquid fuel from the compartment through the pipe, the system comprising:

a plurality of sensors, each of the plurality of sensors configured to detect an event;

a monitoring unit in communication with the plurality of sensors to detect the event, the monitoring unit including a processing unit, a time module, and a memory, the monitoring unit configured to time stamp the sensed event with information from the time module and store the detected and time stamped event in the memory; and a handheld data terminal in communication with the monitoring unit, wherein the handheld data terminal is configured to retrieve and display the stored event, and wherein the handheld data terminal includes a processing unit, a memory, a user interface, a time module, and a display.

24. The monitoring system of claim 23, further comprising:

a computer in communication with the handheld data terminal and configured to retrieve the stored event from the memory of the handheld data terminal, the computer further configured to display the stored event.

25. The monitoring system of claim 23, further comprising:

a global positioning system receiver in communication with the monitoring unit, the monitoring unit configured to interface with the GPS receiver to determine a location of the tanker truck and store the location of the tanker truck.

26. The monitoring system of claim 25, further comprising:

a wireless network interface in communication with the monitoring unit, the monitoring unit configured to communicate the stored event and the stored location across a wireless data network.

27. The monitoring system of claim 23, further comprising:

a wireless network interface in communication with the monitoring unit, the monitoring unit configured to communicate the stored event across a wireless data network.

28. The monitoring system of claim 23, wherein the plurality of sensors includes at least one sensor selected from the group consisting of an overfill sensor configured to indicate whether the fluid in the at least one compartment is above a first predetermined level, a retain sensor configured to indicate whether the fluid in the at least one compartment is above a second predetermined level, a brake sensor configured to indicate whether at least one brake of the tanker truck is engaged, a valve sensor configured to indicate whether at least one American Petroleum Institute valve of the at least one compartment is open, a vapor connection sensor configured to indicate whether at least one vapor connection with the at least one compartment has been established, a ground sensor configured to indicate whether a ground connection between the tanker truck and an electrical ground is established, a socket sensor configured to indicate whether an electrical connection between a monitoring unit and a gantry controller is established, and combinations thereof.

29. The monitoring system of claim 23, wherein the monitoring unit further includes an external communications port, and wherein the handheld data terminal further includes a monitoring unit communications port configured to communicate with the external communications port of the monitoring unit to transfer the stored event from the monitoring unit memory to the handheld data terminal memory.

30. The monitoring system of claim 23, wherein the monitoring unit and handheld data terminal each further include a wireless interface to wirelessly communicate the stored event from the monitoring unit memory to the handheld data terminal memory.

31. The monitoring system of claim 23, wherein the plurality of sensors further comprises at least one retain sensor configured to indicate whether the fluid in the at least one compartment is above a predetermined level, wherein the event is indicated by the at least one retain sensor, wherein the monitoring unit includes a timer reset module, and wherein notification of the event is temporarily silenced in response to an activation of the timer reset module.

32. The monitoring system of claim 23, wherein the display is a liquid crystal display.

33. The monitoring system of claim 23, wherein the display is a touch-screen display.

34. The monitoring system of claim 23, wherein the monitoring unit further includes a plurality of indication lights configured to indicate at least one condition of the at least one compartment, wherein the condition includes conditions selected from the group consisting of an overfill condition, a retain condition, and combinations thereof.

* * * * *